US010341764B2

(12) United States Patent
Barrentine et al.

(10) Patent No.: US 10,341,764 B2
(45) Date of Patent: Jul. 2, 2019

(54) STRUCTURES FOR DYNAMICALLY TUNED AUDIO IN A MEDIA DEVICE

(71) Applicants: Derek Barrentine, Gilroy, CA (US); Michael Edward Smith Luna, San Jose, CA (US); Thomas Alan Donaldson, Nailsworth (GB)

(72) Inventors: Derek Barrentine, Gilroy, CA (US); Michael Edward Smith Luna, San Jose, CA (US); Thomas Alan Donaldson, Nailsworth (GB)

( * ) Notice: Subject to any disclaimer, the term of this patent is extended or adjusted under 35 U.S.C. 154(b) by 0 days.

(21) Appl. No.: 14/243,747

(22) Filed: Apr. 2, 2014

(65) Prior Publication Data

US 2014/0348351 A1 Nov. 27, 2014

Related U.S. Application Data

(63) Continuation of application No. 13/900,943, filed on May 23, 2013.

(51) Int. Cl.
*H04R 1/42* (2006.01)
*H04R 23/00* (2006.01)
(Continued)

(52) U.S. Cl.
CPC ..... *H04R 1/42* (2013.01); *H04R 23/00* (2013.01); *H04R 1/24* (2013.01); *H04R 1/26* (2013.01); *H04R 1/2834* (2013.01)

(58) Field of Classification Search
CPC ..... H04R 1/2834; H04R 1/227; H04R 1/26; H04R 1/24; H04R 1/403; H04R 1/283; H04R 2205/022
(Continued)

(56) References Cited

U.S. PATENT DOCUMENTS 7,120,263 B2 * 10/2006 Azima et al. ..... 381/152
7,823,689 B2 * 11/2010 Aronstam et al. ..... 181/106
(Continued)

FOREIGN PATENT DOCUMENTS

WO 2014189861 A1 11/2014
WO 2014189864 A1 11/2014

OTHER PUBLICATIONS

Young, Lee W., International Searching Authority, Notification of Transmittal of the International Search Report and the Written Opinion of the International Searching Authority, or the Declaration, dated Nov. 3, 2014 for International Patent Application No. PCT/US14/38675.

(Continued)

*Primary Examiner* — Curtis Kuntz
*Assistant Examiner* — Joshua Kaufman

(57) ABSTRACT

Techniques associated with structures for dynamically tuned audio in a media device are described, including receiving data associated with an acoustic output, determining a target frequency response associated with an audio device, the audio device implemented with a hybrid radiator formed using a smart fluid or artificial muscle material, determining a value associated with a property of the smart fluid or artificial muscle material, calculating, using a dynamic tuning application, a magnitude of an external stimulus associated with the value, and sending a control signal to a source, the control signal configured to cause the source to apply the external stimulus, an application of the external stimulus of the determined magnitude configured to change the property of the smart fluid or artificial muscle material.

20 Claims, 6 Drawing Sheets

(51) Int. Cl.
*H04R 1/24* (2006.01)
*H04R 1/26* (2006.01)
*H04R 1/28* (2006.01)

(58) Field of Classification Search
USPC ..... 381/165, 166, 182, 186, 335, 152, 190, 381/191, 424, 426, 431, 386, 395; 181/157, 167, 171, 172, 175, 180, 163
See application file for complete search history.

(56) References Cited

U.S. PATENT DOCUMENTS

| | | | | |
|---|---|---|---|---|
| 8,616,330 | B1 * | 12/2013 | McKnight et al. | 181/207 |
| 2002/0122560 | A1 * | 9/2002 | An | 381/150 |
| 2002/0181715 | A1 | 12/2002 | Kang | |
| 2003/0053643 | A1 * | 3/2003 | Bank et al. | 381/152 |
| 2003/0059069 | A1 * | 3/2003 | Bank et al. | 381/152 |
| 2004/0236375 | A1 | 11/2004 | Redding, Jr. | |
| 2004/0264293 | A1 | 12/2004 | Laugharn et al. | |
| 2005/0226445 | A1 * | 10/2005 | Murray | 381/152 |
| 2009/0118594 | A1 | 5/2009 | Zdeblick | |
| 2011/0248935 | A1 * | 10/2011 | Mellow et al. | 345/173 |
| 2011/0311079 | A1 * | 12/2011 | Keady | 381/166 |
| 2013/0085736 | A1 | 4/2013 | Reihsen et al. | |
| 2014/0029782 | A1 * | 1/2014 | Rayner | 381/386 |
| 2014/0060960 | A1 * | 3/2014 | Walker et al. | 181/175 |
| 2014/0140551 | A1 * | 5/2014 | Ramstein | 381/182 |

OTHER PUBLICATIONS

Huynh, Kim, International Searching Authority, Notification of Transmittal of the International Search Report and the Written Opinion of the International Searching Authority, or the Declaration, dated Sep. 26, 2014 for International Patent Application No. PCT/US14/38670.

Non-Final Office Action dated Jul. 28, 2014 for U.S. Appl. No. 13/900,943.

Non-Final Office Action dated Mar. 31, 2015, 2014 for U.S. Appl. No. 13/900,943.

* cited by examiner

STRUCTURES FOR DYNAMICALLY TUNED AUDIO IN A MEDIA DEVICE

CROSS-REFERENCE TO RELATED APPLICATIONS

This application is a continuation of U.S. patent application Ser. No. 13/900,943, filed May 23, 2013, which is incorporated by reference herein in its entirety for all purposes.

FIELD OF THE INVENTION

The invention relates generally to electrical and electronic hardware, computer software, wired and wireless network communications, and computing devices. More specifically, techniques relating to structures for dynamically tuned audio in a media device are described.

BACKGROUND OF THE INVENTION

Conventional media devices with audio capabilities have physical limitations on the quality of their audio output. Although conventional speaker systems are capable of implementing passive radiators to improve acoustic output in various low frequency ranges, conventional passive radiators typically are tuned by mass, and thus also suffer physical limitations. Lighter weight speaker cabinets or housings are unable to support heavier passive radiators, and suffer sound distortion and unwanted vibration if mounted with heavier passive radiators.

Furthermore, conventional passive radiators formed using conventional materials typically are tuned to a set frequency or predetermined range of frequencies upon formation, as their mass, stiffness and other properties, cannot be adjusted or modified reliably once the passive radiators are formed. Thus, conventional audio devices typically are not well suited to be dynamically tuned to optimize acoustic output at different frequency ranges.

Thus, what is needed is a solution for dynamically tuned audio in a media device without the limitations of conventional techniques.

BRIEF DESCRIPTION OF THE DRAWINGS

Various embodiments of the invention are disclosed in the following detailed description and the accompanying drawings.

Figure 1:
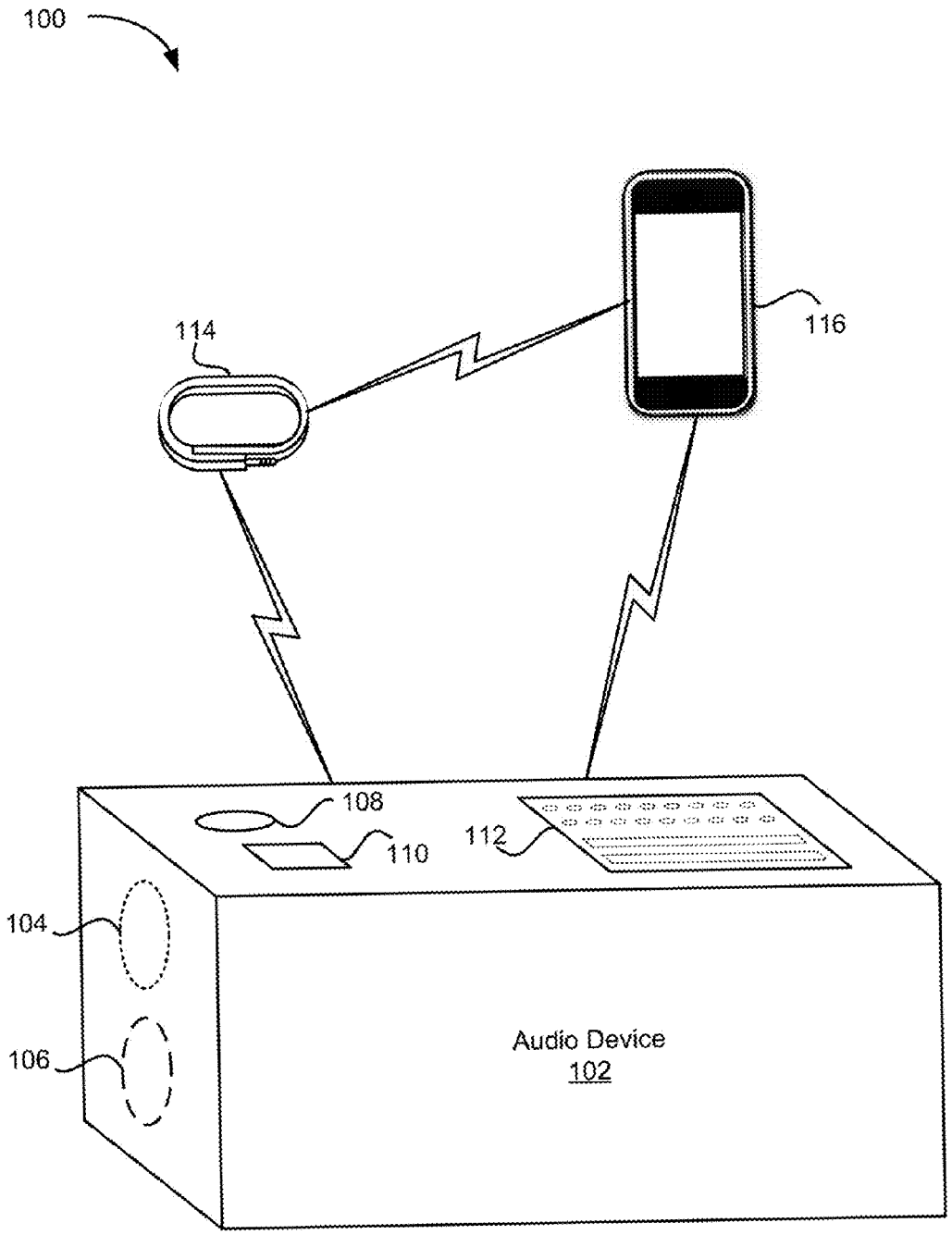
FIG. 1 illustrates an exemplary system of media devices, according to some examples.

Although the above-described drawings depict various examples of the invention, the invention is not limited by the depicted examples. It is to be understood that, in the drawings, like reference numerals designate like structural elements. Also, it is understood that the drawings are not necessarily to scale.

DETAILED DESCRIPTION

Various embodiments or examples may be implemented in numerous ways, including as a system, a process, an apparatus, a user interface, or a series of program instructions on a computer readable medium such as a computer readable storage medium or a computer network where the program instructions are sent over optical, electronic, or wireless communication links. In general, operations of disclosed processes may be performed in an arbitrary order, unless otherwise provided in the claims.

A detailed description of one or more examples is provided below along with accompanying figures. The detailed description is provided in connection with such examples, but is not limited to any particular example. The scope is limited only by the claims and numerous alternatives, modifications, and equivalents are encompassed. Numerous specific details are set forth in the following description in order to provide a thorough understanding. These details are provided for the purpose of example and the described techniques may be practiced according to the claims without some or all of these specific details. For clarity, technical material that is known in the technical fields related to the examples has not been described in detail to avoid unnecessarily obscuring the description.

In some examples, the described techniques may be implemented as a computer program or application ("application") or as a plug-in, module, or sub-component of another application. The described techniques may be implemented as software, hardware, firmware, circuitry, or a combination thereof. If implemented as software, then the described techniques may be implemented using various types of programming, development, scripting, or formatting languages, frameworks, syntax, applications, protocols, objects, or techniques, including ASP, ASP.net, .Net framework, Ruby, Ruby on Rails, C, Objective C, C++, C#, Adobe® Integrated Runtime™ (Adobe® AIR™), ActionScript™, Flex™, Lingo™, Java™, Javascript™, Ajax, Perl, COBOL, Fortran, ADA, XML, MXML, HTML, DHTML, XHTML, HTTP, XMPP, PHP, and others. Software and/or firmware implementations may be embodied in a non-transitory computer readable medium configured for execution by a general purpose computing system or the like. The described techniques may be varied and are not limited to the examples or descriptions provided.

Techniques associated with structures for dynamically tuned audio in a media device are described. As described herein, a media device may be implemented with a hybrid radiator configured to be dynamically tuned for different target frequency responses. As used herein, "hybrid radiator" may refer to a structure similar to a passive radiator and configured to change properties in response to external stimulus, for example, by being formed using smart fluid or artificial muscle materials.

FIG. 1 illustrates an exemplary system of media devices, according to some examples. Here, system 100 includes audio device 102, wearable device 114 and mobile device 116. In some examples, audio device 102 may include driver 104, hybrid radiator 106, buttons 108-110, and display 112. In some examples, audio device 102 may be configured to communicate (i.e., using short range communication protocols (e.g., Bluetooth®, ultra wideband, NFC, or the like) or longer range communication protocols (e.g., satellite, mobile broadband, GPS, IEEE 802.11a/b/g/n (WiFi), and the like)) with wearable device 114 and mobile device 116, for example, using a communication facility (not shown). In some examples, wearable device 114 and mobile device 116 also may be configured to communicate (i.e., exchange data) with each other. In some examples, wearable device 114 may be configured as a data capture device, including one or more sensors (e.g., accelerometer, altimeter/barometer, light/infrared ("IR") sensor, pulse/heart rate ("HR") monitor, audio sensor (e.g., microphone, transducer, or others), pedometer, velocimeter, global positioning system (GPS) receiver, location-based service sensor (e.g., sensor for determining location within a cellular or micro-cellular network, which may or may not use GPS or other satellite constellations for fixing a position), motion detection sensor, environmental sensor, chemical sensor, electrical sensor, or mechanical sensor, and the like) for collecting local sensor data associated with a user. In some examples, wearable device 114 may be configured to communicate sensor data to audio device 102 and mobile device 116, for further processing. For example, sensor data from wearable device 114 may be used by an application or algorithm implemented by audio device 102 or mobile device 116 to effect audio playback or other audio output. In some examples, mobile device 116 may be configured to run various applications, including one or more applications for playing media content (e.g., audio, video, or the like). For example, mobile device 116 may be configured to run a media playing application configured to cause audio device 102 to output audio associated with a media content being played.

In some examples, driver 104 and hybrid radiator 106 may be mounted on or in audio device 102 to provide audio output. In some examples, audio device 102 may include more than one driver, for example to reproduce a different range of frequencies, as well as more than one hybrid radiator. In some examples, driver 104 may be part of a loudspeaker system, and may be implemented as a full-range driver, a subwoofer, a woofer, a mid-range driver, a tweeter, a coaxial driver, or other type of driver, without limitation. In some examples, hybrid radiator 106 may be implemented similarly to a passive radiator with additional capabilities, including an ability to be dynamically tuned using external stimulus. In some examples, hybrid radiator 106 may be configured to receive and react (i.e., move in response) to acoustic energy (e.g., provided by driver 104 or other components capable of producing acoustic energy), for example, to strengthen and clarify sounds in a target range of frequencies (i.e., in a low range of frequencies). In some examples, hybrid radiator 106 may be formed using a smart fluid (i.e., a fluid whose properties may be changed by application of an electric or magnetic field) or artificial muscle (i.e., a material that can reversibly contract or expand in response to an external stimulus (e.g., voltage, current, pressure, temperature, or the like)) material (e.g., magnetorheological fluid, electrorheological fluid, other electroactive polymers, or the like), wherein one or more properties (e.g., stiffness, viscosity, yield stress, surface tension, compliance, resistance to flow, shape and the like) of the smart fluid may be changed by applying an electric or magnetic field, an electric current, or other external stimulus, to the material. For example, where hybrid radiator 106 is formed using magnetorheological fluid, application of a magnetic field may increase viscosity or stiffness of hybrid radiator 106, and increasing or decreasing the magnetic field may modify viscosity or stiffness of hybrid radiator 106. In some examples, changes in viscosity and stiffness of hybrid radiator 106 may tune hybrid radiator 106 to a desired or target range of frequencies (i.e., optimize a response by hybrid radiator 106 to a desired or target range of frequencies). In another example, where hybrid radiator 106 is formed using an electrorheological fluid, an application of an electric field may increase resistance to flow of hybrid radiator 106, which may tune hybrid radiator 106 to a desired or target range of frequencies. In still other examples, where hybrid radiator 106 is formed using one of various types of electroactive polymers, an application of an electric field or current may modify stiffness or shape of hybrid radiator 106, which may tune hybrid radiator 106 to a desired or target range of frequencies.

In some examples, display 112 may be implemented as a light panel using a variety of available display technologies, including lights, light-emitting diodes (LEDs), interferometric modulator display (IMOD), electrophoretic ink (E Ink), organic light-emitting diode (OLED), or the like, without limitation. In other examples, display 112 may be implemented as a touchscreen, another type of interactive screen, a video display, or the like. In some examples, audio device 102 may include software, hardware, firmware, or other circuitry (not shown), configured to implement a program (i.e., application) configured to cause control signals to be sent to display 112, for example, to cause display 112 to present a light pattern, a graphic or symbol (e.g., associated with battery life, communication capabilities, or the like), a message or other text (e.g., a notification, information regarding audio being played, information regarding characteristics of audio device 102, or the like), a video, or the like. In some examples, buttons 108-110 may be configured to execute control functions associated with audio device 102, including, without limitation, to turn audio device 102 on or off, adjust a volume, set an alarm, request information associated with audio device 102 (e.g., regarding battery life, communication protocol capabilities, or the like), provide a response to a prompt from audio device 102, or the like. In some examples, audio device 102 may provide haptic, audio or visual feedback using driver 104, hybrid radiator 106, and display 112. For example, driver 104 and hybrid radiator 106 may be configured to rumble, vibrate, or otherwise provide haptic feedback in response to a button selection (e.g., using buttons 108-110, or the like), for example, indicating a request for remaining battery life. In this example, a weaker or smaller vibration or rumble may indicate low battery life, and a stronger rumble may indicate a healthy battery life. In another example, driver 104 may be configured to cause audio device 102 to output a sound in response to such a request (e.g., a descending tone to indicate low battery life or a negative response, an ascending tone to indicate high battery life or a positive response, a higher tone, a lower tone, a softer tone, a louder tone, a short song, or the like). In still another example, display 112 may be dimmed when battery life is low, or when ambient lighting is low, for example, where sensor data from wearable device 114 indicates that the room is dark. In yet another example, display 112 may flash brightly (i.e., momentarily display a bright light, pattern or graphic) to indicate a healthy battery life in response to a button selection requesting battery life information. In still other examples, driver 104 and hybrid radiator 106 may be configured to provide various types of haptic and audio feedback, and display 112 may be configured to provide various types of visual feedback, in different situations. In yet other examples, the quantity, type, function, structure, and configuration of the elements shown may be varied and are not limited to the examples provided.

Figure 2A:
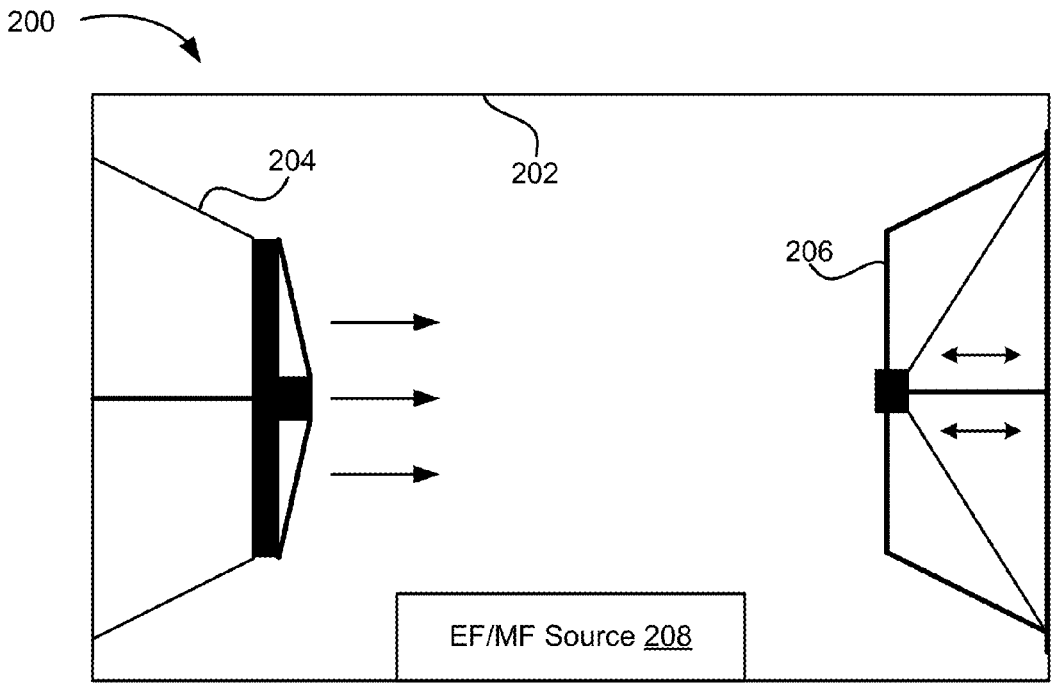
FIGS. 2A-2B illustrate exemplary devices having dynamically tuned audio components, according to some examples.
Figure 2B:
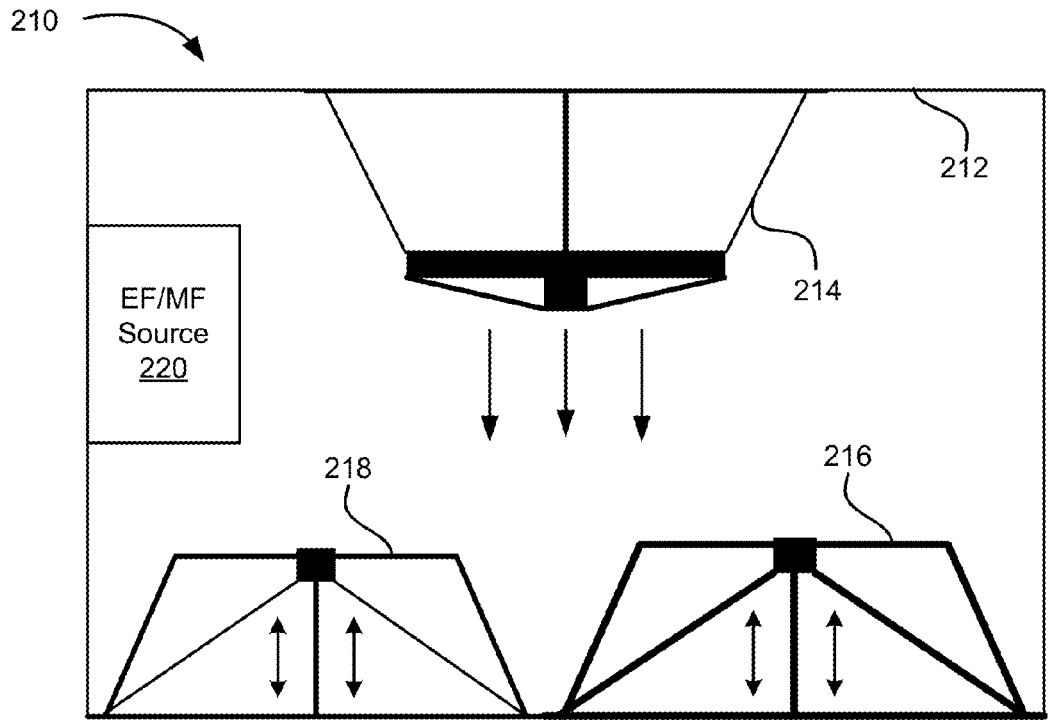

FIGS. 2A-2B illustrate exemplary devices having dynamically tuned audio components, according to some examples. In FIG. 2A, device 200 includes housing 202, driver 204, hybrid radiator 206 and electric/magnetic field source 208. Like-numbered and named elements may describe the same or substantially similar elements as those shown in other descriptions. In some examples, driver 204 may be implemented as part of a loudspeaker system, as described herein. In some examples, hybrid radiator 206 may be configured to receive and move in response to acoustic energy, for example, being produced by driver 204. In some examples, driver 204 may produce acoustic energy within housing 202, for example, largely in a direction toward hybrid radiator 206, and a cone within hybrid radiator 206 may move in a linear direction in response to said acoustic energy from driver 204, as shown. In some examples, hybrid radiator 206 may be configured to strengthen, augment, increase, and/or clarify sounds in a target range of frequencies (i.e., in a low or Bass range of frequencies). In some examples, hybrid radiator 206 may be tuned dynamically to change a range of frequencies for which a response from hybrid radiator 206 is optimized. In some examples, this may be achieved by forming hybrid radiator 206 using a smart fluid or artificial muscle material (e.g., magnetorheological fluid, electrorheological fluid, other electroactive polymers, or the like), wherein one or more properties (e.g., stiffness, viscosity, yield stress, surface tension, compliance, resistance to flow, shape, and the like) of the material may be changed by applying an electric or magnetic field, an electric current, or other external stimulus to the material. In some examples, electric/magnetic field source 208 may be configured to apply an electric and/or magnetic field, an electric current, or other stimulus, to hybrid radiator 206, thereby changing one or more properties of hybrid radiator 206. For example, where hybrid radiator 206 is formed using magnetorheological fluid, electric/magnetic field source 208 may apply a magnetic field to increase viscosity or stiffness of hybrid radiator 206, thereby tuning hybrid radiator 206 to a target frequency or range of frequencies. In another example, electric/magnetic field source 208 may be configured to increase or decrease a magnetic field being applied to hybrid radiator 206, which may modify viscosity or stiffness of hybrid radiator 206, thereby tuning it to a different target frequency or range of frequencies. In yet another example, where hybrid radiator 206 is formed using an electrorheological fluid or electroactive polymer, electric/magnetic field source 208 may apply an electric field or current to increase stiffness (i.e., resistance to flow) or shape of hybrid radiator 206, which may tune hybrid radiator 206 to a target frequency or range of frequencies. In still another example, electric/magnetic field source 208 may be configured to increase or decrease an electric field or current being applied to hybrid radiator 206, which may modify a stiffness or shape of hybrid radiator 206 and thereby tune hybrid radiator 206 to a different target frequency or range of frequencies. In some examples, electric/magnetic field source 208 may be implemented as one or more devices configured to produce and modify an electric field or current, a magnetic field, or both. In some examples, electric/magnetic field source 208 may be controlled using a control device (not shown) configured to implement a dynamic tuning application (e.g., dynamic tuning applications 308 and 330 in FIGS. 3A-3B) and to cause control signals to be sent to electric/magnetic field source 208, for example, to cause electric/magnetic field source 208 to apply or adjust an electric or magnetic field, electric current, or other stimulus to hybrid radiator 206.

In some examples, more than one hybrid radiator may be implemented in a device having dynamically tuned audio components, as shown in FIG. 2B. In FIG. 2B, device 210 includes housing 212, driver 214, hybrid radiators 216-218, electric/magnetic field source 220, and wire 222. Like-numbered and named elements may describe the same or substantially similar elements as those shown in other descriptions. In some examples, hybrid radiator 216 and hybrid radiator 218 may be formed of same or similar material and mass, and thus be tuned similarly (i.e., for a same or similar frequency or range of frequencies) using electric/magnetic field source 220 to have a similar response to each other. In other examples, hybrid radiator 216 may be configured with a different mass, and/or formed using a different smart fluid or artificial muscle material, than hybrid radiator 218, and thus be tuned differently, or to have a different response to acoustic energy produced by driver 214. For example, hybrid radiators 216 and 218 may be formed using the same smart fluid or artificial muscle material, but hybrid radiator 216 may have a greater mass than hybrid radiator 218, and thus may be tuned to respond optimally to a different target frequency or range of frequencies than hybrid radiator 218. In another example, hybrid radiator 216 may be formed using a different smart fluid or artificial muscle material, and thus may exhibit a different change (i.e., in magnitude or type) to the same electric or magnetic field applied by electric/magnetic field source 220. In still another example, hybrid radiator 216 may be formed using an electrorheological fluid, and hybrid radiator 218 may be formed using a magnetorheological fluid, thereby enabling each of hybrid radiator 216 and 218 to be tuned separately, one using an electric field and another using a magnetic field (e.g., as may be applied using electric/magnetic field source 220 alone, or in conjunction with a different source of an electric or magnetic field, or the like). In other examples, the quantity, type, function, structure, and configuration of the elements shown may be varied and are not limited to the examples provided.

Figure 3A:
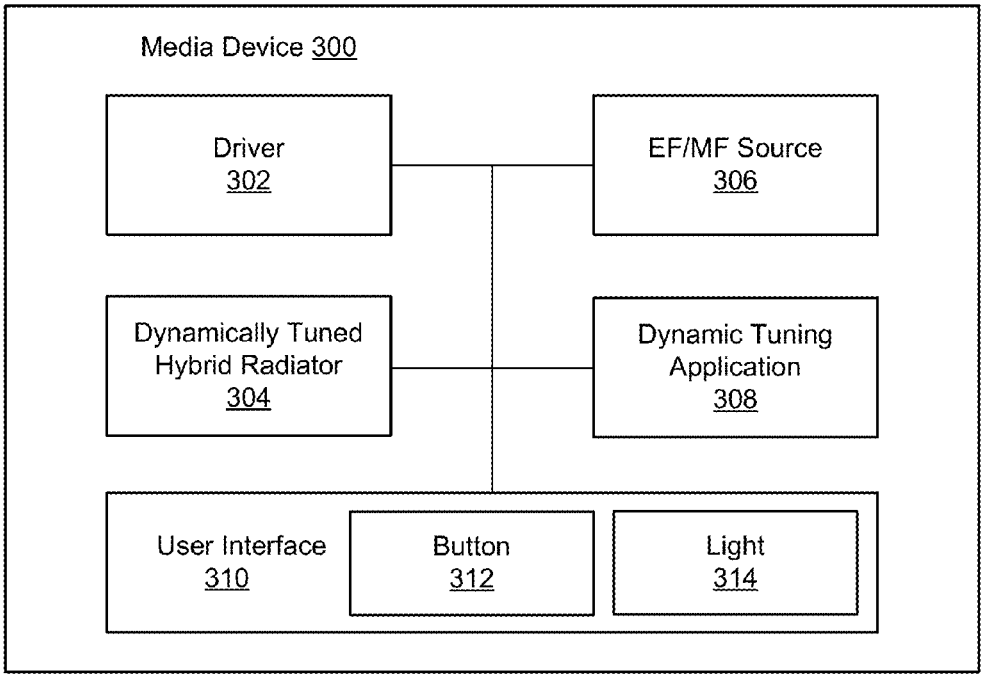
FIG. 3A illustrates an exemplary media device having dynamically tuned audio, according to some examples.

FIG. 3A illustrates an exemplary media device having dynamically tuned audio, according to some examples. Here, media device 300 includes driver 302, dynamically tuned hybrid radiator (hereinafter "hybrid radiator") 304, electric/magnetic field source 306, dynamic tuning application 308, and user interface 310, which may include button 312 and light 314. Like-numbered and named elements may describe the same or substantially similar elements as those shown in other descriptions. In some examples, dynamic tuning application 308 may be configured to implement a dynamic tuning algorithm configured to determine one or more characteristics associated with a magnetic or electric field for achieving a desired frequency response from hybrid radiator 304. In some examples, dynamic tuning application 308 may be configured to cause control signals to be sent to electric/magnetic field source 306 to produce or adjust an electric and/or magnetic field, electric current, or other stimulus, to be applied to hybrid radiator 304, and thereby to tune hybrid radiator 304, for example to match a desired equalization or target frequency response, as described herein. For example, dynamic tuning application 308 may be configured to determine a target frequency response associated with a loudspeaker system implemented in media device 300 (i.e., a loudspeaker system including driver 302 and hybrid radiator 304), to determine a value associated with a property of hybrid radiator 304 and with achieving said target frequency response using hybrid radiator 304, and to calculate, using the value, a magnitude of an electric or magnetic field to be applied to hybrid radiator 304. In some examples, dynamic tuning application 308 may be configured to receive data (i.e., acoustic data or audio data) associated with desired audio or acoustic output (i.e., associated with a media content) to be, or being, played over a period of time, and to determine or calculate a plurality of target frequency responses, a plurality of values associated with one or more properties of hybrid radiator 304, and a plurality of magnitudes of a magnetic or electric field to be applied (i.e., in a sequence associated with said audio or acoustic output). In other examples, the quantity, type, function, structure, and configuration of the elements shown may be varied and are not limited to the examples provided.

In some examples, media device 310 also may include user interface 310, which may be implemented with button 312 and light 314. In other examples, user interface 310 may include other buttons and displays (not shown) (e.g., buttons 108-110 and display 112 in FIG. 1). In some examples, media device 310 may be configured to receive user input (e.g., using button 312, or the like), and to provide haptic, audio or visual feedback (e.g., using a loudspeaker system (e.g., including driver 302, hybrid radiator 304, and the like), light 314, other displays, or the like). In some examples, media device 300 may be implemented with logic, processing capabilities, or other circuitry (not shown) configured to perform control functions associated with user interface 310 and dynamic tuning application 308.). In other examples, the quantity, type, function, structure, and configuration of the elements shown may be varied and are not limited to the examples provided.

Figure 3B:
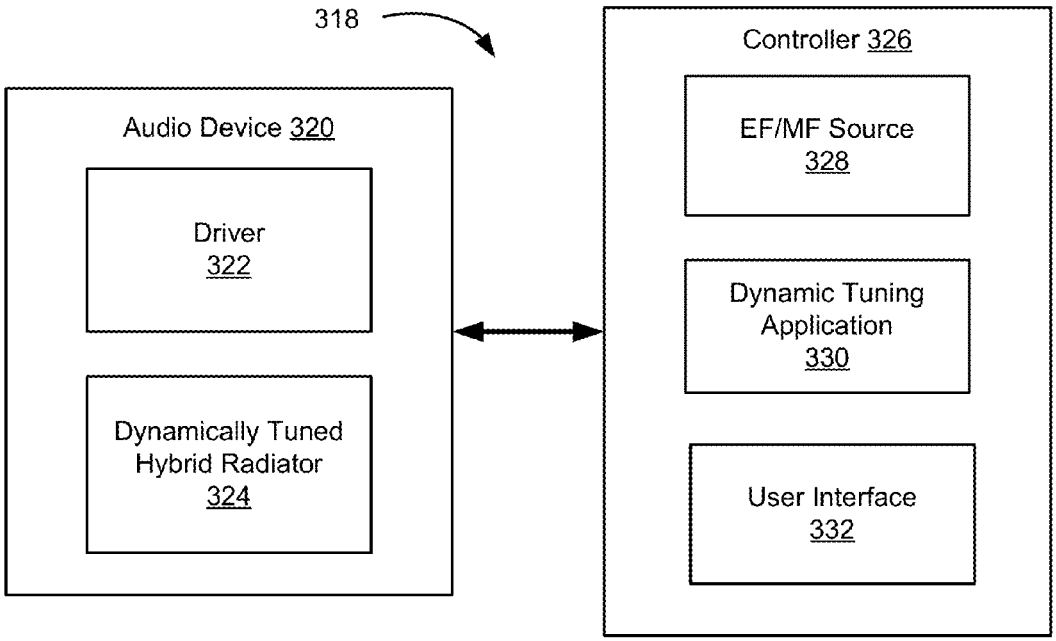
FIG. 3B illustrates an exemplary media system including a dynamically tuned audio device, according to some examples.

FIG. 3B illustrates an exemplary media system including a dynamically tuned audio device, according to some examples. Here, system 318 includes audio device 320 and controller 326. In some examples, audio device 320 may include driver 322 and dynamically tuned hybrid radiator (hereinafter "hybrid radiator") 324. In some examples, controller 326 may include electric/magnetic field source 328, dynamic tuning application 330 and user interface 332. Like-numbered and named elements may describe the same or substantially similar elements as those shown in other descriptions. In some examples, the control functions performed by electric/magnetic field source 328 and dynamic tuning application 330 may be implemented in controller 326, and separate from audio device 320. In some examples, audio device 320 may be implemented as a speaker or speaker system (i.e., loudspeaker). In some examples, audio device 320 and controller 326 may be communicatively coupled (i.e., capable of exchanging data or electrical signals) using a wired or wireless connection. In some examples, electric/magnetic field source 328 further may be implemented separately from controller 326 (not shown), in a device communicatively coupled to controller 326, such that dynamic tuning application 330 may cause control signals to be sent to electric/magnetic field source 328. In some examples, user interface 332 may be implemented with one or more buttons, lights, and/or displays, as described herein. In other examples, the quantity, type, function, structure, and configuration of the elements shown may be varied and are not limited to the examples provided.

Figure 4:
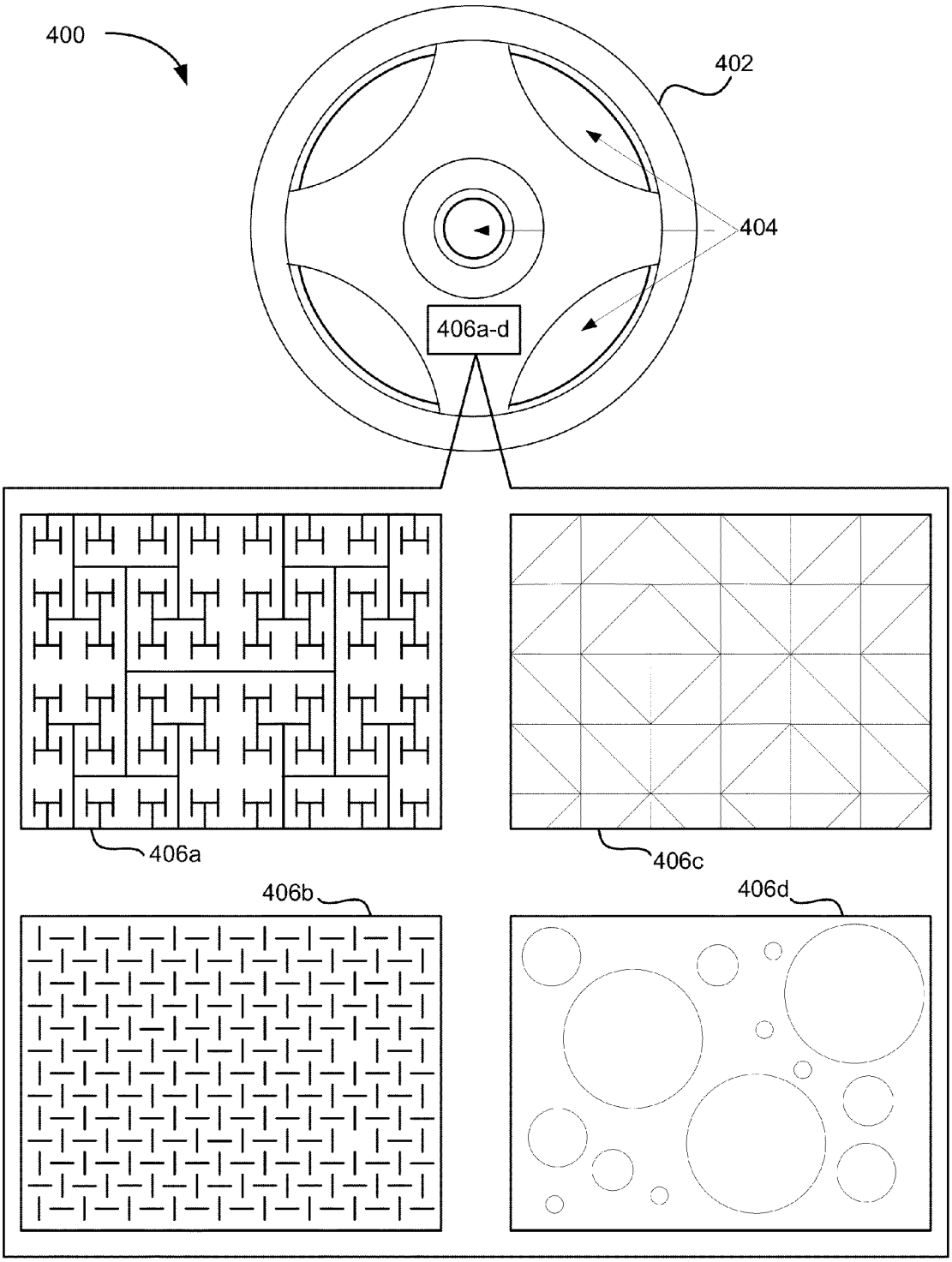
FIG. 4 illustrates a diagram depicting an exemplary dynamically tuned hybrid radiator formed with a surface pattern, according to some examples.

FIG. 4 illustrates a diagram depicting an exemplary dynamically tuned hybrid radiator formed with a surface pattern, according to some examples. Here, diagram 400 includes hybrid radiator 402, a cone 404 housed within hybrid radiator 402, and patterns 406*a-d*. Like-numbered and named elements may describe the same or substantially similar elements as those shown in other descriptions. In some examples, a surface (e.g., an exterior surface, a partial or whole surface, or the like) of hybrid radiator 402 may be stamped, printed, molded or otherwise provided with a pattern configured to have an effect on an amount of acoustic energy being transferred (i.e., passed) through said surface, for example, to increase or decrease the acoustic energy received by cone 404. In some examples, a surface of hybrid radiator 402 may be provided with a fractal pattern (e.g., pattern 406*a* or the like), or an irregular pattern (e.g., pattern 406*d* or the like), configured to have a varied, modulated, or otherwise undefined, impedance, for example, to better couple said surface to air (i.e., to better match acoustic impedances). In other examples, a surface of hybrid radiator 402 may be provided with a repetitive or more defined pattern (e.g., patterns 406*b*-406*c* or the like), to otherwise effect an amount of acoustic energy received or passed through said surface. In some examples, these patterns may be implemented on a surface of hybrid radiator 402 in a three-dimensional manner. In other examples, other three-dimensional patterns, for example resembling an anechoic chamber design, may be implemented on a surface of hybrid radiator 402 to change an amount of acoustic energy received or passed through said surface. In some examples, a pattern may be provided on more than one surface of hybrid radiator 402 (i.e., including on a surface of one or more components of hybrid radiator 402, for example, cone 404), for example, to improve surface to air coupling of said surfaces. In other examples, one or more patterns may be provided on different surfaces of various components of hybrid radiator 402 (i.e., one pattern may be provided on an external surface of hybrid radiator 402, while a different pattern may be provided on a surface of cone 404. In other examples, a surface of a housing (not shown) to which hybrid radiator 402 may be mounted also may be provided with one or more patterns configured to change an amount of acoustic energy being transferred through or received by said housing. In still other examples, the quantity, type, function, structure, and configuration of the elements shown may be varied and are not limited to the examples provided.

Figure 5:
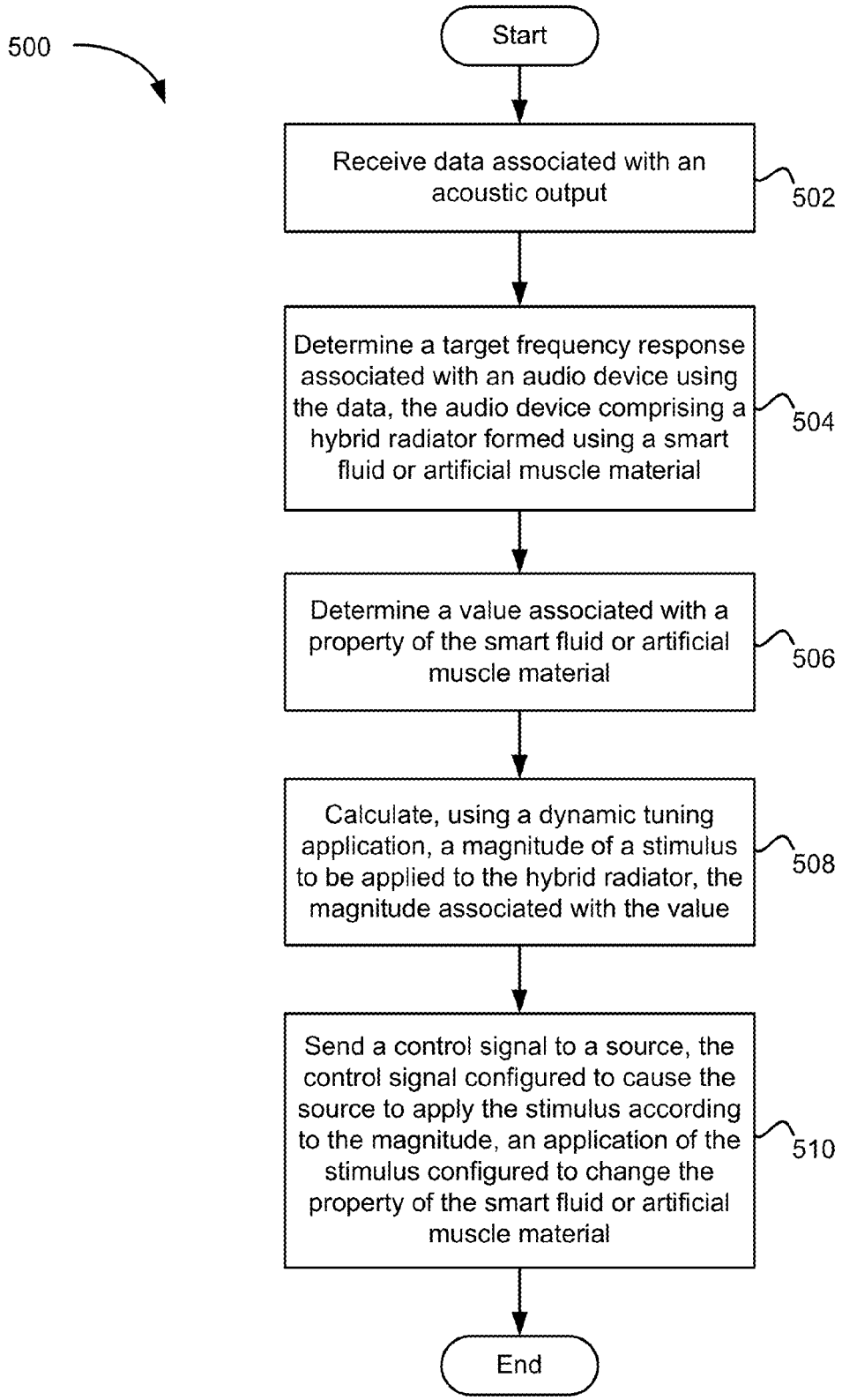
FIG. 5 illustrates an exemplary flow for dynamically tuning audio in a media device, according to some examples.

FIG. 5 illustrates an exemplary flow for dynamically tuning audio in a media device, according to some examples. Here, flow 500 begins with receiving data associated with an acoustic output (502). In some examples, said acoustic output may be associated with a media content (e.g., an audio or audio/video file, for example, associated with a playlist, a movie, a video, a radio station feed, or the like). In some examples, said acoustic output may be associated with a stream or set of audio data. Once said data is received, a target frequency response associated with an audio device (i.e., configured to provide said acoustic output) may be determined using the data, the audio device comprising a hybrid radiator formed using a smart fluid or artificial muscle material (504). In some examples, said hybrid radiator may be configured to be tuned using an external stimulus (e.g., an electric field or current, magnetic field, or the like), as described herein. In some examples, an audio device may be implemented with one or more drivers (i.e., loudspeaker) and configured to play said audio (i.e., provide said acoustic output) may be implemented with two or more hybrid radiators, which may be tuned similarly or separately, as described herein. In some examples, a plurality of target frequency responses may be determined where a set of data associated with a media content is received, or streamed over a period of time, the set of data indicating a series of acoustic outputs to be provided in a sequence. Once a target frequency response is determined, a value associated with a property of the smart fluid or artificial muscle material may be determined (506). In some examples, said value may be correlated with the target frequency response, and determined using a dynamic tuning application, as described herein. A magnitude of a stimulus to be applied to the hybrid radiator may be calculated, the magnitude being associated with the value (508). In some examples, the stimulus may include one or more of an electric field, electric current, or magnetic field. In some examples, the magnitude may be calculated using a dynamic tuning application, which may be configured to perform one or more of the determinations and calculations described herein (e.g., dynamic tuning applications 308 and 330 in FIGS. 3A-3B). Once a magnitude of a stimulus is determined, a control signal may be sent to a source, the control signal configured to cause the source to apply the stimulus according to the magnitude, an application of the stimulus configured to change the property of the smart fluid or artificial muscle material (510). In some examples, where a series of acoustic outputs are to be provided in a sequence, a plurality of values may be determined, and a plurality of magnitudes of stimulus calculated, the plurality of magnitudes to be applied in a sequence determined using, or otherwise associated with, said series of acoustic outputs. In some examples, a plurality of control signals may be sent to said source to modulate or modify the stimulus being applied to said hybrid radiator, to tune said hybrid radiator according to a series of desired equalizations or target frequency responses, which may be correlated with acoustic energy or output being provided by a driver implemented in said audio device. In other examples, the above-described process may be varied in steps, order, function, processes, or other aspects, and is not limited to those shown and described.

Figure 6:
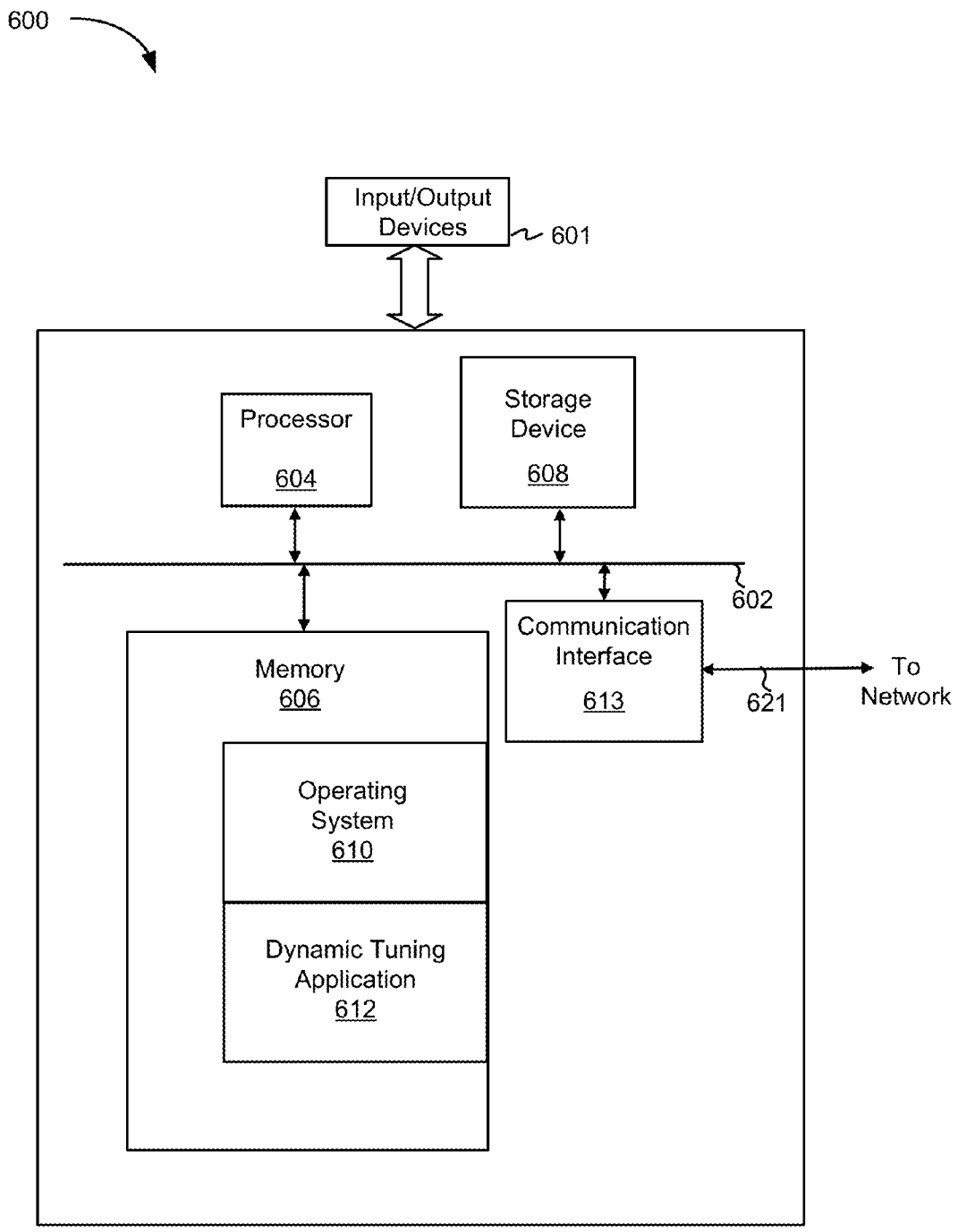
FIG. 6 illustrates an exemplary computing platform suitable for implementing dynamically tuned audio in a media device, according to some examples.

FIG. 6 illustrates an exemplary computing platform suitable for implementing dynamically tuned audio in a media device, according to some examples. In some examples, computing platform 600 may be used to implement computer programs, applications, methods, processes, algorithms, or other software to perform the above-described techniques. Computing platform 600 includes a bus 602 or other communication mechanism for communicating information, which interconnects subsystems and devices, such as processor 604, system memory 606 (e.g., RAM, etc.), storage device 608 (e.g., ROM, etc.), a communication interface 613 (e.g., an Ethernet or wireless controller, a Bluetooth controller, etc.) to facilitate communications via a port on communication link 621 to communicate, for example, with a computing device, including mobile computing and/or communication devices with processors. Processor 604 can be implemented with one or more central processing units ("CPUs"), such as those manufactured by Intel® Corporation, or one or more virtual processors, as well as any combination of CPUs and virtual processors. Computing platform 600 exchanges data representing inputs and outputs via input-and-output devices 601, including, but not limited to, keyboards, mice, audio inputs (e.g., speech-to-text devices), user interfaces (e.g., user interfaces 310 and 332 in FIGS. 3A-3B), LCD or LED or other displays (e.g., display 112 in FIG. 1), monitors, cursors, touch-sensitive displays, speakers, media players and other I/O-related devices.

According to some examples, computing platform 600 performs specific operations by processor 604 executing one or more sequences of one or more instructions stored in system memory 606, and computing platform 600 can be implemented in a client-server arrangement, peer-to-peer arrangement, or as any mobile computing device, including smart phones and the like. Such instructions or data may be read into system memory 606 from another computer readable medium, such as storage device 608. In some examples, hard-wired circuitry may be used in place of or in combination with software instructions for implementation. Instructions may be embedded in software or firmware. The term "computer readable medium" refers to any non-transitory medium that participates in providing instructions to processor 604 for execution. Such a medium may take many forms, including but not limited to, non-volatile media and volatile media. Non-volatile media includes, for example, optical or magnetic disks and the like. Volatile media includes dynamic memory, such as system memory 606.

Common forms of computer readable media includes, for example, floppy disk, flexible disk, hard disk, magnetic tape, any other magnetic medium, CD-ROM, any other optical medium, punch cards, paper tape, any other physical medium with patterns of holes, RAM, PROM, EPROM, FLASH-EPROM, any other memory chip or cartridge, or any other medium from which a computer can read. Instructions may further be transmitted or received using a transmission medium. The term "transmission medium" may include any tangible or intangible medium that is capable of storing, encoding or carrying instructions for execution by the machine, and includes digital or analog communications signals or other intangible medium to facilitate communication of such instructions. Transmission media includes coaxial cables, copper wire, and fiber optics, including wires that comprise bus 602 for transmitting a computer data signal.

In some examples, execution of the sequences of instructions may be performed by computing platform 600. According to some examples, computing platform 600 can be coupled by communication link 621 (e.g., a wired network, such as LAN, PSTN, or any wireless network) to any other processor to perform the sequence of instructions in coordination with (or asynchronous to) one another. Computing platform 600 may transmit and receive messages, data, and instructions, including program code (e.g., application code) through communication link 621 and communication interface 613. Received program code may be executed by processor 604 as it is received, and/or stored in memory 606 or other non-volatile storage for later execution.

In the example shown, system memory 606 can include various modules that include executable instructions to implement functionalities described herein. In the example shown, system memory 606 includes an operating system 610 configured to perform management functions and provide common services for various components of computing platform 600. System memory 606 also may include dynamic tuning application 612, which may be configured to make determinations and calculations associated with tuning a hybrid radiator to optimize acoustic output, as described herein (see, e.g., dynamic tuning applications 308 and 330 in FIGS. 3A-3B).

In some embodiments, various devices described herein may communicate (e.g., wired or wirelessly) with each other, or with other compatible devices, using computing platform 600. As depicted in FIGS. 1-4 herein, the structures and/or functions of any of the above-described features can be implemented in software, hardware, firmware, circuitry, or any combination thereof. Note that the structures and constituent elements above, as well as their functionality, may be aggregated or combined with one or more other structures or elements. Alternatively, the elements and their functionality may be subdivided into constituent sub-elements, if any. As software, at least some of the above-described techniques may be implemented using various types of programming or formatting languages, frameworks, syntax, applications, protocols, objects, or techniques. For example, at least one of the elements depicted in FIGS. 1-4 can represent one or more algorithms. Or, at least one of the elements can represent a portion of logic including a portion of hardware configured to provide constituent structures and/or functionalities.

As hardware and/or firmware, the above-described structures and techniques can be implemented using various types of programming or integrated circuit design languages, including hardware description languages, such as any register transfer language ("RTL") configured to design field-programmable gate arrays ("FPGAs"), application-specific integrated circuits ("ASICs"), multi-chip modules, or any other type of integrated circuit. For example, dynamic tuning applications 308 and 330, display 112, user interfaces 310 and 332, and electric/magnetic field sources 208, 220, 306 and 328, including one or more components, can be implemented in one or more computing devices that include one or more circuits. Thus, at least one of the elements in FIGS. 1-4 can represent one or more components of hardware. Or, at least one of the elements can represent a portion of logic including a portion of circuit configured to provide constituent structures and/or functionalities.

According to some embodiments, the term "circuit" can refer, for example, to any system including a number of components through which current flows to perform one or more functions, the components including discrete and complex components. Examples of discrete components include transistors, resistors, capacitors, inductors, diodes, and the like, and examples of complex components include memory, processors, analog circuits, digital circuits, and the like, including field-programmable gate arrays ("FPGAs"), application-specific integrated circuits ("ASICs"). Therefore, a circuit can include a system of electronic components and logic components (e.g., logic configured to execute instructions, such that a group of executable instructions of an algorithm, for example, and, thus, is a component of a circuit). According to some embodiments, the term "module" can refer, for example, to an algorithm or a portion thereof, and/or logic implemented in either hardware circuitry or software, or a combination thereof (i.e., a module can be implemented as a circuit). In some embodiments, algorithms and/or the memory in which the algorithms are stored are "components" of a circuit. Thus, the term "circuit" can also refer, for example, to a system of components, including algorithms. These can be varied and are not limited to the examples or descriptions provided.

The foregoing description, for purposes of explanation, uses specific nomenclature to provide a thorough understanding of the invention. However, it will be apparent to one skilled in the art that specific details are not required in order to practice the invention. In fact, this description should not be read to limit any feature or aspect of the present invention to any embodiment; rather features and aspects of one embodiment can readily be interchanged with other embodiments. Notably, not every benefit described herein need be realized by each embodiment of the present invention; rather any specific embodiment can provide one or more of the advantages discussed above. In the claims, elements and/or operations do not imply any particular order of operation, unless explicitly stated in the claims. It is intended that the following claims and their equivalents define the scope of the invention. Although the foregoing examples have been described in some detail for purposes of clarity of understanding, the above-described inventive techniques are not limited to the details provided. There are many alternative ways of implementing the above-described invention techniques. The disclosed examples are illustrative and not restrictive.

What is claimed is:

1. A method, comprising:

receiving acoustic data associated with an acoustic output;

determining, using the acoustic data, a target low frequency response associated with an audio device, the audio device comprising a hybrid radiator formed using a smart fluid;

determining a value associated with a property of the smart fluid, the value being determined based on the target low frequency response associated with the audio device;

calculating, using a dynamic tuning application implementing a dynamic tuning algorithm, a magnitude of an external stimulus associated with the value, wherein the magnitude of the external stimulus is calculated, based on the dynamic tuning algorithm, to modify the property of the smart fluid to achieve the target low frequency response at the hybrid radiator; and sending a control signal to a source, the control signal configured to cause the source to apply the external stimulus of the magnitude, the external stimulus including an electric current, an application of the external stimulus configured to change the property of the smart fluid.

2. The method of claim 1, wherein the change to the property of the smart fluid is configured to tune the hybrid radiator to a target range of low frequencies.

3. The method of claim 1, wherein calculating the magnitude of the external stimulus comprises calculating the magnitude of an electric field.

4. The method of claim 1, wherein calculating the magnitude of the external stimulus comprises calculating the magnitude of a magnetic field.

5. The method of claim 1, further comprising providing the acoustic output using the audio device.

6. The method of claim 1, wherein the dynamic tuning algorithm is further configured to determine an optimal magnitude of the external stimulus based on the property of the smart fluid.

7. The method of claim 1, further comprising changing the property using the application of the external stimulus, the property comprising a stiffness and a yield stress.

8. The method of claim 1, further comprising changing the property using the application of the external stimulus, the property comprising a viscosity and a compliance.

9. The method of claim 1, further comprising changing the property using the application of the external stimulus, the property comprising a surface tension.

10. The method of claim 1, further comprising changing the property using the application of the external stimulus, the property comprising a shape and a resistance to flow.

11. A method, comprising:

receiving data associated with an acoustic output;

determining, using the data, a target low frequency response associated with an audio device, the audio device comprising a hybrid radiator formed using an artificial muscle material;

determining a value associated with a property of the artificial muscle material, the value being determined based on the target low frequency response associated with the audio device;

calculating, using a dynamic tuning application implementing a dynamic tuning algorithm, a magnitude of an external stimulus associated with the value, wherein the magnitude of the external stimulus is calculated, based on the dynamic tuning algorithm, to modify the property of the artificial muscle material to achieve the target low frequency response at the hybrid radiator; and sending a control signal to a source, the control signal configured to cause the source to apply the external stimulus of the magnitude, the external stimulus including an electric current, an application of the external stimulus configured to change the property of the artificial muscle material.

12. The method of claim 11, wherein the change to the property of the artificial muscle material is configured to tune the hybrid radiator to a target range of low frequencies.

13. The method of claim 11, wherein calculating the magnitude of the external stimulus comprises calculating the magnitude of an electric field.

14. The method of claim 11, wherein calculating the magnitude of the external stimulus comprises calculating the magnitude of a magnetic field.

15. The method of claim 11, further comprising providing the acoustic output using the audio device.

16. The method of claim 11, wherein the dynamic tuning algorithm is further configured to determine an optimal magnitude of the external stimulus based on the property of the artificial muscle material.

17. The method of claim 11, further comprising changing the property using the application of the external stimulus, the property comprising a stiffness and a yield stress.

18. The method of claim 11, further comprising changing the property using the application of the external stimulus, the property comprising a viscosity and a compliance.

19. The method of claim 11, further comprising changing the property using the application of the external stimulus, the property comprising a surface tension.

20. The method of claim 11, further comprising changing the property using the application of the external stimulus, the property comprising a shape and a resistance to flow.

* * * * *